United States Patent [19]

Shinagawa et al.

[11] Patent Number: 5,051,234

[45] Date of Patent: Sep. 24, 1991

[54] HIGH CORROSION-RESISTANT ELECTROMAGNETIC STAINLESS STEELS

[75] Inventors: Susumu Shinagawa; Yoshinobu Saito, both of Sendai, Japan

[73] Assignee: Tohoku Special Steel Works Limited, Sendai, Japan

[21] Appl. No.: 524,429

[22] Filed: May 17, 1990

[30] Foreign Application Priority Data

May 20, 1989 [JP] Japan ..... 1-125579

[51] Int. Cl.[5] ..... C22C 38/28

[52] U.S. Cl. ..... 420/61; 148/325; 420/40; 420/70

[58] Field of Search ..... 420/61, 40, 70; 148/325

[56] References Cited

U.S. PATENT DOCUMENTS

| | | | |
|---|---|---|---|
| 3,953,201 | 4/1976 | Wood et al. | 420/61 |
| 4,059,440 | 11/1977 | Takemura et al. | 420/61 |
| 4,360,381 | 11/1982 | Tarutani et al. | 420/61 |
| 4,420,335 | 12/1983 | Takagi et al. | 420/61 |
| 4,461,811 | 7/1984 | Borneman et al. | 420/70 |
| 4,465,525 | 8/1984 | Yoshimura et al. | 420/40 |
| 4,652,428 | 3/1987 | Maruhashi et al. | 420/62 |
| 4,690,798 | 9/1987 | Narutani et al. | 490/61 |
| 4,714,502 | 12/1987 | Honkura et al. | 420/70 |
| 4,799,972 | 1/1989 | Masuyama et al. | 148/325 |
| 4,938,808 | 7/1990 | Miura et al. | 148/325 |

*Primary Examiner*—Upendra Roy

*Attorney, Agent, or Firm*—Young & Thompson

[57] ABSTRACT

A high corrosion-resistant electromagnetic stainless steel comprises particular amounts of C, Si, Mn, Cr, Mo, Ti, Cu, Al and the balance being Fe, and is used as a material for a housing of electronically controlled fuel injection system for automobile or an electromagnetic valve. This steel may further contain particular amounts of Pb, Ca, Se, S and rare earth elements, if necessary.

4 Claims, No Drawings

HIGH CORROSION-RESISTANT ELECTROMAGNETIC STAINLESS STEELS

BACKGROUND OF THE INVENTION

1. Field of the Invention

This invention relates to high corrosion-resistant electromagnetic stainless steels having not only an excellent corrosion resistance but also good soft magnetic properties and workability, particularly cold forgeability, and more particularly to high corrosion-resistant electromagnetic stainless steels suitable for use in a housing for an electronically controlled fuel injection system for automobiles, an electromagnetic valve for water requiring corrosion resistance and the like.

2. Related Art Statement

The demand for recently developed electronically controlled fuel, injection systems has rapidly increased with the rapid advance of car electronics.

In this connection, pure iron; silicon steel containing 3% of Si, 13Cr-Si, or Al series ferritic stainless steel have hitherto been used as a material for such an electronically controlled fuel injection system.

Lately, dust pollution from road damage of based on the use of spike tires in the winter season is getting more and more aggravated, so that the use of spike tires tends to be prohibited in vehicles other than emergency vehicles. As a result, it is attempted to improve snow-removing or snow melting conditions, and a great amount of a snow melting agent such as magnesium chloride, calcium chloride or the like is used.

Since such a chloride is very strongly corrosive, however, it is required to have a higher corrosion resistance in a material for various parts of the automobile running on roads scattered with the snow melting agent. This is also true of the electronically controlled fuel injection system for automobiles. In this connection, sufficiently satisfactory corrosion resistance could not be expected in the aforementioned conventional steels.

To this end, it is attempted to improve the corrosion resistance by plating the above part or coating the part with a resin as a countermeasure.

However, rust occurs due to the defects such as pinholes or the like in case of the plating or due to the gap between resin and magnetic material in case of the resin coating, and consequently satisfactory corrosion resistance is not obtained and also the cost rises.

As a material having high corrosion resistance, there are austenitic stainless steels such as SUS 304 (18Cr-8Ni), SUS 316 (18Cr-12Ni-2Mo) and the like. However, these alloys are non-magnetic, so that they cannot be used as a material for the housing of electronically controlled fuel injection system for automobiles.

Since a practical material having a level of corrosion resistance equal to that of SUS 304 and good soft magnetic, properties does not exist at the present, there is a strong demand to develop such a material.

Moreover, the material for the housing of the electronically controlled fuel injection system for automobiles is also required to have a good cold forgeability in addition to the above properties because it is advantageous to conduct cutting, drilling and cold forging in order to cheaply enable mass production.

SUMMARY OF THE INVENTION

It is, therefore, an object of the invention to advantageously solve the aforementioned problems and to provide high corrosion-resistant electromagnetic stainless steels sufficiently resistant to corrosion from chloride largely scattered as a snow melting agent and having excellent soft magnetic properties and cold forgeability.

According to the invention, there is provided a high corrosion-resistant electromagnetic stainless steel comprising C: not more than 0.015 wt% (hereinafter shown by % simply), Si: not more than 0.30%, Mn: not more than 0.30%, Cr: 10.0–20.0%, Mo: 0.5–2.0%, Ti: 0.05–0.30%, Cu: 0.3–1.5%, Al: 0.05–1.5% and the balance being substantially Fe.

In a preferred embodiment of the invention, the steel further contains at least one of Pb: 0.03–0.3%, Ca: 0.002–0.03%, Se: 0.01–0.2% and S: 0.01–0.1% for improving the machinability.

In another preferred embodiment of the invention, the above steel further contains 0.0005–0.01% of at least one rare earth element for further improving the cold forgeability.

DESCRIPTION OF THE PREFERRED EMBODIMENTS

The invention will be described in detail below.

At first, the reason why the chemical composition of the steel according to the invention is limited to the above range is as follows. C: not more than 0.015%

C is a harmful element considerably degrading the corrosion resistance, magnetic properties and cold forgeability of stainless steel, so that it is desired to reduce the C amount as far as possible. Therefore, the C amount is acceptable to be not more than 0.015%.

Si: not more than 0.30%

Si is not only useful as a deoxidizer but also effectively contributes to the improvement of magnetic properties in 13Cr series ferritic stainless steel and further increases the electric resistivity to improve the response property in the high frequency region, but undesirably increases the hardness to considerably degrade the cold forgeability. Considering the above, the Si amount is not more than 0.30%.

Mn: not more than 0.30%

Mn effectively acts as a deoxidizer, but obstructs the magnetic properties, so that the Mn amount is not more than 0.30%.

Cr: 10.0–20.0%

Cr is essential in the alloy according to the invention and is an element most effective for improving the corrosion resistance, magnetic properties and electric resistivity. Particularly, Cr brings about the further improvement of corrosion resistance and magnetic properties together with Mo, Cu and Ti. However, when the Cr amount is less than 10.0%, the addition effect is poor, while when it exceeds 20.0%, the magnetic properties, particularly magnetic flux density decline and the cold forgeability is degraded, so that the Cr amount is restricted to a range of 10.0–20.0%.

Mo: 0.5–2.0%

Mo is a useful element effectively improving the corrosion resistance together with Cu, Ti. Furthermore, the coercive force (Hc) of the alloy according to the invention is improved by adding a small amount of Mo. However, when the Mo amount is less than 0.5%, the addition effect is poor, while when it exceeds 2.0%, the cold forgeability is degraded and the cost becomes high, so that the Mo amount is restricted to a range of 0.5–2.0%.

Ti: 0.05–0.30%

Ti effectively contributes to the improvement of corrosion resistance and magnetic properties together with Cr or further Mo, Cu. When the Ti amount is less than 0.05%, the effect is insufficient, while when it exceeds 0.30% degradation of cold forgeability is caused and a special refining is required, which raises the cost, so that the Ti amount is restricted to a range of 0.05–0.30%.

Cu: 0.3–1.5%

Cu is a useful element considerably improving the corrosion resistance together with Cr or further Mo, Ti. Furthermore, Cu effectively improves the cold forgeability by its addition in a small amount and causes less degradation of magnetic properties. When the amount is less than 0.3%, the addition effect is poor, while when it exceeds 1.5%, the magnetic properties are largely degraded and the hardness considerably increases and the cold forgeability is obstructed, so that the Cu amount is limited to a range of 0.3–1.5%.

Al: 0.05–1.5%

Al is a useful element considerably improving the magnetic properties and effectively increasing the electrical resistivity in 13Cr series ferritic stainless steels. Furthermore the cold forgeability is not obstructed by the addition in a relatively small amount. When the Al amount is less than 0.05%, the improving effect of magnetic properties is insufficient, while when it exceeds 1.5%, a special refining is required and the cold forgeability is degraded, so that the Al amount is restricted to a range of 0.05–1.5%.

According to the invention, at least one of Pb: 0.03–0.3%, Ca: 0.002–0.03%, Se: 0.01–0.2% and S: 0.01–0.1% may be added to the above chemical composition for improving the machinability.

When the amount of each of these auxiliary elements is less than the lower limit, the addition effect is poor, while when it exceeds the upper limit, the corrosion resistance, magnetic properties and cold forgeability are degraded, so that it is important to satisfy the above mentioned range even when these elements are added alone or in admixture.

Moreover, according to the invention, the cold forgeability can be further improved by the addition of rare earth element. However, when the amount of the rare earth element is less than 0.0005%, the addition effect is poor, while when it exceeds 0.01%, a special melting and refining process is required and the cost becomes high, so that the amount of rare earth element is restricted to a range of 0.0005–0.01%.

As the rare earth element, it is particularly advantageous to use Mischmetal.

The alloys according to the invention are produced by the same methods as in the conventional techniques, among which a typical production method is as follows.

At first, the above components are melted and then shaped into an ingot in a usual manner. As the melting method, a refining method such as AOD, VOD or the like, or a melting in a non-oxidizing atmosphere is advantageous. After the melting, a billet is formed by casting or a continuous casting, which is then hot rolled at about 800°–1100° C. to obtain a given bar. This bar is subjected scarfing drawing and low temperature finish annealing to obtain a product. For example, when the thus obtained product is used as a material for the housing of the electronically controlled fuel injection system for automobiles, it is subjected to a step for the production of the housing.

The following example is given in illustration of the invention and is not intended a limitation thereof.

Three kilograms of a test steel (No. 1–No. 14) having a chemical composition shown in the following Table 1 was melted through induction in a stream of Ar and shaped into an ingot of 50 mm in diameter. Then, the ingot was hot forged at 1050° C. to obtain a bar of 13 mm in diameter, which was subjected to an annealing at 850° C for 2 hours to obtain a test specimen.

The magnetic properties, specific resistivity, mechanical properties, cold forgeability and corrosion resistance were measured with respect to the thus obtained test specimen to obtain results as shown in Tables 2, 3 and 4.

Moreover, the measurement of each property was conducted as follows.

As to the magnetic properties, a ring sample of 10 mm outer diameter ×5.5 mm inner diameter ×5 mm thickness was prepared and direct current properties thereof were measured by B-H loop tracer.

The electrical resistance was measured by means of a digital voltmeter after each specimen was cold drawn to 1 mm in diameter and annealed at 850° C. under vacuum.

As to the mechanical properties, a tensile testing sample of 5 mm diameter ×25 mm was prepared and subjected to a test by means of an Instron type tensile testing machine.

As to the cold forgeability, a test sample of 6 mm diameter ×11 mm height was prepared and subjected to a compression test by means of a hydraulic press to measure the limiting working ratio as to cracks.

The corrosion resistance was evaluated by preparing a test, sample of 8 mm diameter ×80 mm, polishing with No. 500 sand paper, spraying an aqueous solution of 5% NaCl at 35° C. for 96 hours and measuring the presence or absence of rust occurrence. Furthermore, the pitting potential was measured in an aqueous solution of 3.5% NaCl at 30° C. after a test sample of 13 mm diameter ×5 mm was prepared and polished with No. 800 sand paper.

TABLE 1

(wt %)

| No. | C | Si | Mn | Cu | Cr | Mo | Ti | Al | S | Pb | Se | Ca | M.M. | Ce | La |
|---|---|---|---|---|---|---|---|---|---|---|---|---|---|---|---|
| | | | | | | | Invention steel | | | | | | | | |
| 1 | 0.008 | 0.27 | 0.29 | 0.81 | 10.20 | 1.86 | 0.16 | 0.21 | — | — | — | — | — | — | — |
| 2 | 0.003 | 0.28 | 0.28 | 0.48 | 13.62 | 1.03 | 0.12 | 0.20 | — | — | — | — | — | — | — |
| 3 | 0.008 | 0.29 | 0.28 | 0.34 | 18.51 | 0.97 | 0.12 | 0.21 | — | — | — | — | — | — | — |
| 4 | 0.007 | 0.25 | 0.28 | 0.48 | 13.63 | 0.96 | 0.12 | 1.34 | — | — | — | — | — | — | — |
| 5 | 0.007 | 0.24 | 0.26 | 0.48 | 13.62 | 0.98 | 0.28 | 0.20 | — | — | — | — | — | — | — |
| 6 | 0.002 | 0.24 | 0.26 | 0.48 | 18.61 | 0.51 | 0.12 | 0.21 | — | — | — | — | — | — | — |
| 7 | 0.008 | 0.24 | 0.25 | 0.49 | 13.58 | 0.98 | 0.15 | 0.21 | 0.03 | — | 0.03 | — | — | — | — |

TABLE 1-continued

| No. | C | Si | Mn | Cu | Cr | Mo | Ti | Al | S | Pb | Se | Ca | M.M. | Ce | (wt %) La |
|---|---|---|---|---|---|---|---|---|---|---|---|---|---|---|---|
| 8 | 0.010 | 0.26 | 0.24 | 0.51 | 13.60 | 0.97 | 0.15 | 0.21 | — | 0.05 | — | 0.001 | 0.0011 | — | — |
| 9 | 0.011 | 0.28 | 0.26 | 0.55 | 13.58 | 0.98 | 0.15 | 0.20 | — | — | — | — | — | 0.0021 | 0.0011 |
| | | | | | | | Comparative steel | | | | | | | | |
| 10 | 0.008 | 0.27 | 0.26 | 0.44 | 7.15 | 0.51 | 0.12 | 0.22 | — | — | — | — | — | — | — |
| 11 | 0.003 | 0.30 | 0.29 | — | 13.64 | — | 0.12 | 0.24 | — | — | — | — | — | — | — |
| 12 | 0.031 | 0.28 | 0.28 | 0.48 | 13.62 | 0.97 | 0.52 | 0.25 | — | — | — | — | — | — | — |
| 13 | 0.011 | 0.27 | 0.27 | 1.51 | 13.64 | 2.49 | 0.12 | 0.22 | — | — | — | — | — | — | — |
| 14 | 0.010 | 0.27 | 0.27 | 0.48 | 25.11 | 1.05 | 0.12 | 2.06 | — | — | — | — | — | — | — |

TABLE 2

| No. | Magnetic flux density (G) $B_1$ | $B_{10}$ | $B_{25}$ | Coercive force (Oé) Hc | Specific resistance (μΩ-cm) ρ |
|---|---|---|---|---|---|
| | | | Invention steel | | |
| 1 | 6200 | 12100 | 13200 | 0.68 | 63 |
| 2 | 5700 | 12000 | 12900 | 0.74 | 65 |
| 3 | 5700 | 11100 | 12000 | 0.70 | 64 |
| 4 | 7100 | 10500 | 12700 | 0.64 | 93 |
| 5 | 6800 | 11800 | 12700 | 0.67 | 64 |
| 6 | 6800 | 11600 | 12300 | 0.61 | 67 |
| 7 | 5200 | 10700 | 11900 | 0.78 | 64 |
| 8 | 6700 | 11800 | 12700 | 0.65 | 63 |
| | | | Comparative steel | | |
| 9 | 6500 | 11700 | 12700 | 0.68 | 65 |
| 10 | 7400 | 12400 | 13300 | 0.60 | 58 |
| 11 | 7000 | 10400 | 12300 | 0.75 | 63 |
| 12 | 1250 | 9300 | 11300 | 1.81 | 64 |
| 13 | 1740 | 8400 | 9300 | 1.95 | 68 |
| 14 | 1800 | 7500 | 8200 | 0.77 | 109 |

TABLE 3

| No. | Mechanical properties: yield strength (kgf/mm²) | tensile strength (kgf/mm²) | elongation (%) | reduction of area (%) | Hardness ($H_RB$) | Limiting working ratio on cracks (%) |
|---|---|---|---|---|---|---|
| | | | Invention steel | | | |
| 1 | 24.8 | 45.8 | 45.1 | 88.4 | 68 | 81 |
| 2 | 29.8 | 45.7 | 44.8 | 87.8 | 71 | 82 |
| 3 | 32.9 | 48.2 | 38.7 | 86.5 | 76 | 75 |
| 4 | 37.5 | 52.5 | 38.7 | 87.5 | 81 | 77 |
| 5 | 29.8 | 45.7 | 44.5 | 87.8 | 71 | 83 |
| 6 | 30.0 | 45.4 | 39.1 | 87.0 | 72 | 80 |
| 7 | 28.8 | 45.6 | 42.4 | 85.3 | 72 | 81 |
| 8 | 29.5 | 42.7 | 42.1 | 86.8 | 70 | 82 |
| 9 | 28.7 | 41.8 | 38.6 | 87.1 | 70 | 83 |
| | | | Comparative steel | | | |
| 10 | 25.1 | 40.3 | 38.2 | 84.5 | 58 | 83 |
| 11 | 26.3 | 41.4 | 41.4 | 78.9 | 65 | 78 |
| 12 | 46.0 | 58.6 | 41.9 | 76.2 | 87 | 65 |
| 13 | 41.9 | 63.1 | 36.4 | 71.2 | 86 | 109 |
| 14 | 48.1 | 64.9 | 23.8 | 68.0 | 86 | 61 |

TABLE 4

| No. | Salt spray test* 5% NaCl, 35° C., 96h | Pitting potential (mV) 3.5% NaCl, 35° C. |
|---|---|---|
| | Invention steel | |
| 1 | ○ | 240 |
| 2 | ○ | 270 |
| 3 | ○ | 370 |
| 4 | ○ | 270 |
| 5 | ○ | 284 |
| 6 | ○ | 300 |
| 7 | ○ | 220 |
| 8 | ○ | 265 |
| 9 | ○ | 285 |
| | Comparative steel | |
| 10 | x | 40 |
| 11 | Δ | 85 |

TABLE 4-continued

| No. | Salt spray test* 5% NaCl, 35° C., 96h | Pitting potential (mV) 3.5% NaCl, 35° C. |
|---|---|---|
| 12 | x | 35 |
| 13 | ○ | 470 |
| 14 | ○ | 740 |

*Test piece: φ8 mm × 80 mm × 2 pieces
○: no occurrence of rust in two pieces
Δ: occurrence of rust in one of two pieces
x: occurrence of rust in two pieces In the above tables, the steel No. 10 is an example in which Cr is not more than 10%, and the steel No. 11 is an example in which Cu and Mo are not contained. These comparative examples are good in the magnetic properties, mechanical properties, hardness and cold forgeability, but are insufficient in the corrosion resistance and rust occurs in the saline spray test.

The steel No. 12 is an example in which the amounts of C and Ti exceed the upper limit, respectively. That is, the steel contains a large amount of C, so that the magnetic properties, cold forgeability and corrosion resistance are insufficient.

The steel No. 13 is an example in which the amounts of Cu and Mo exceed the upper limit, respectively. Therefore, the corrosion resistance is good. However, the magnetic properties are largely degraded, and also an increase of hardness, decrease of drawing value and limiting working ratio are caused and the cold forgeability is degraded.

The steel No. 14 is an example containing large amounts of Cr and Al. In this case, the corrosion resistance is very excellent and a good value of not less than 100 μΩ-cm is obtained as a specific resistivity. However, the magnetic flux density is substantially lowered. Therefore, when this steel is used for electronically controlled fuel injection systems for automobiles or electromagnetic valves, a risk of decreasing suction force becomes high. Further, not only the increase of hardness but also the decrease of limiting working ratio are caused, so that sufficient cold forgeability is not obtained.

On the contrary, the steels obtained according to the invention (No. 1–No. 9) have very excellent magnetic properties of $Hc \leqq 0.80$ (Oé), $B_1 \geqq 5000$ (G), $B_{10} \geqq 10000$ (G) and $B_{25} \geqq 12000$ (G), a good cold forgeability in which the drawing value is not less than 85% and the limiting drawing ratio is not less than 75%, and an excellent corrosion resistance in which no rust occurs in the saline spray test for 96 hours.

As mentioned above, according to the invention, high corrosion-resistant electromagnetic stainless steels exhibiting very excellent corrosion resistance even in a highly corrosive environment of chloride and having good magnetic properties and cold forgeability can be obtained, so that they serve well as a material for a housing of an electronically controlled fuel injection system for automobiles or an electromagnetic value used in a corrosive environment.

What is claimed is:

1. A high corrosion-resistant electromagnetic stainless steel comprising C: not more than 0.015 wt%, Si: not more than 0.30 wt%, Mn: not more than 0.30 wt%, Cr: 10.0–20.0 wt%, Mo: 0.5–2.0 wt%, Ti: 0.05–0.30 wt%, Cu: 0.3–1.5 wt%, Al: from substantially more than 0.6 wt% to 1.5 wt% and the balance being essentially Fe.

2. The high corrosion-resistant electromagnetic stainless steel according to claim 1, wherein said steel further contains at least one of Pb: 0.03–0.3 wt%, Ca: 0.002–0.03 wt%, Se: 0.01–0.2 wt% and S: 0.01–0.1 wt%.

3. The high corrosion-resistant electromagnetic stainless steel according to claim 1 or 2, wherein said steel further contains 0.0005–0.01 wt% of at least one rare earth element.

4. The high corrosion-resistant electromagnetic stainless steel according to claim 3, wherein said rare earth element is a Mischmetal.

* * * * *